United States Patent [19]

Kozacka et al.

[11] 3,935,553

[45] Jan. 27, 1976

[54] CARTRIDGE FUSE FOR D-C CIRCUITS

[75] Inventors: Frederick J. Kozacka, South Hampton, N.H.; Edward J. Knapp, Jr., Newburyport; Philip C. Jacobs, Jr., Newtonville, both of Mass.

[73] Assignee: The Chase-Shawnut Company, Newburyport, Mass.

[22] Filed: Jan. 3, 1974

[21] Appl. No.: 430,537

[52] U.S. Cl. ..... 337/159; 337/160; 337/290; 337/295; 337/296

[51] Int. Cl. ..... H01h 85/04

[58] Field of Search ..... 337/159, 160, 231, 278, 337/279, 295, 296

[56] References Cited

UNITED STATES PATENTS

| | | | |
|---|---|---|---|
| 3,113,195 | 12/1963 | Kozacka | 337/279 |
| 3,261,952 | 7/1966 | Kozacka | 337/159 |

FOREIGN PATENTS OR APPLICATIONS

| | | | |
|---|---|---|---|
| 497,223 | 5/1930 | Germany | 337/159 |

*Primary Examiner*—J. D. Miller
*Assistant Examiner*—Fred E. Bell
*Attorney, Agent, or Firm*—Erwin Salzer

[57] ABSTRACT

A d-c fuse having a clearing ability ranging from currents close to the minimum fusing current to major fault currents is provided with a wide ribbon fuse link having a matrix-like system of perforations. The fuse link is wrapped around gas-evolving rod means in such a fashion as to form a gap between the longitudinal edges thereof resulting in the formation of currents of arc-quenching gas evolving from said rod means and flowing transversely across said edges of said ribbon fuse link.

4 Claims, 5 Drawing Figures

CARTRIDGE FUSE FOR D-C CIRCUITS

BACKGROUND OF THE INVENTION

The problem of interrupting excessive d-c currents by means of electric fuses differs in many respects significantly from the problem of interruption of excessive a-c currents by means of electric fuses. For this reason many manufacturers of fuses have two different lines of fuses, one intended for application in a-c circuits and one intended for application in d-c circuits.

Commercially available d-c fuses designed for relatively high current ratings and involving a plurality of fusible elements which are connected in parallel perform generally fairly well both on major fault currents and relatively small protracted overload currents. At lower current ratings satisfactory interruption tends to become more difficult. One of the most onerous instances is the interruption by means of a fuse having a relatively low current rating and consequently but one single fusible element of a d-c circuit having a relatively large time constant and carrying a very small overload current for a long period of time prior to blowing of the fuse. Under such conditions the back burn velocity of the fusible element tends to be so small as to make it difficult, or impossible, to force the current down to zero.

The prime object of this invention is to provide d-c power fuses for relatively small current ratings which operate satisfactorily under all conditions including major fault error conditions and small protracted overload current conditions, and also including relatively highly inductive circuits.

SUMMARY OF THE INVENTION

D-c fuses embodying this invention include straight rod means of a gas-evolving electric insulating material arranged inside the casing or fuse tube substantially parallel to the longitudinal axis thereof. Said rod means have a circumference of predetermined length. D-c fuses embodying this invention further include a ribbon fuse link having a portion having a predetermined width substantially exceeding the length of said circumference of said rod means. Said portion of said ribbon fuse link has a plurality of transverse lines of perforations and a plurality of longitudinal columns of perforations. Said portion of said fuse link is wrapped around said rod means so as to position said rod means relative to said portion of said fuse link, and said portion of said fuse link forms a gap between the longitudinal edges thereof causing the escape of arc-quenching gases from said rod means transversely across said longitudinal edges of said portion of said fuse link.

DESCRIPTION OF PREFERRED EMBODIMENTS

Figure 1:
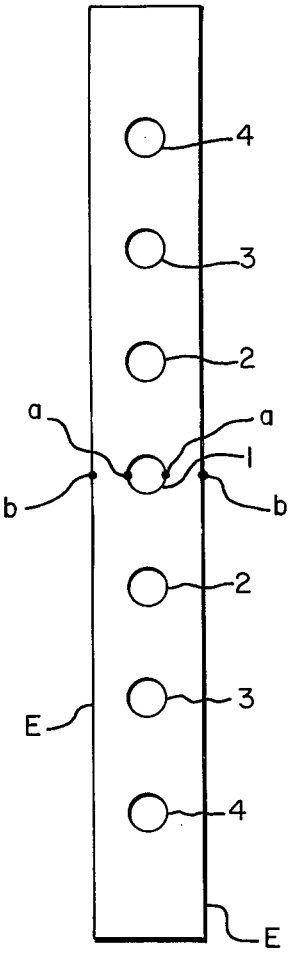
FIG. 1 PRIOR ART
FIGS. 1 and 2 are diagrammatic representations of prior art fuse links.

The description of preferred embodiments of the invention will be preceded by a brief analysis of the behavior of ribbon fuse links. FIG. 1 shows a narrow ribbon fuse link having seven circular perforations 1 to 4. Each of the seven circular perforations forms a pair of points of reduced cross-sectional area, each of said points being situated to opposite sides of one of said seven circular perforations. When the ribbon fuse link, or fusible element in ribbon form, is carrying current heat is generated in it resulting in a characteristic distribution of spot temperatures. There is a temperature gradient in a direction longitudinally of the fuse link. The temperature peak is situated immediately adjacent the centrally located perforation 1 and the temperature drops in longitudinal direction gradually toward perforations 2 and further to perforations 3 and 4. The smallest temperature prevails adjacent the ends of the fusible element where the same is affixed and conductively connected to a pair of terminal elements, e.g. ferrules (not shown in FIG. 1). There is also a temperature gradient in transverse direction. The temperature is lowest immediately adjacent the edges E of the fusible element and highest immediately adjacent the circular perforations 1 to 4. The temperature gradients in a direction longitudinally of the fuse link and in transverse direction are responsible for the behavior of a fuse under various conditions of excess currents. Considering the case of a relatively small overload of excessive duration, fusion is initiated at the hottest points of the fusible element or fuse link marked *a* and tends to propagate to the next hottest points marked *b*. The fuse link is thus severed at a single point exactly at its center by sharp transverse incisions which initiates arcing and backburn. This interposes so much arc resistance that heat generation adjacent perforations 2–4 is drastically reduced. Therefore the points of reduced cross-sectional area adjacent perforations 2–4 never melt on account of $i^2 \cdot r$ losses proper occurring therein, but may be heated so as to fuse and vaporize only by backburn of the arc initially kindled at lines a,b. The fuse fails at small current intensities if the current is too small to generate the backburn speed and concomitant arc voltage required to force the current down to zero.

At very high fault currents breaks are formed at perforations 1 to 4 in such a rapid sequence that one deems these events generally as occurring simultaneously.

Figure 2:
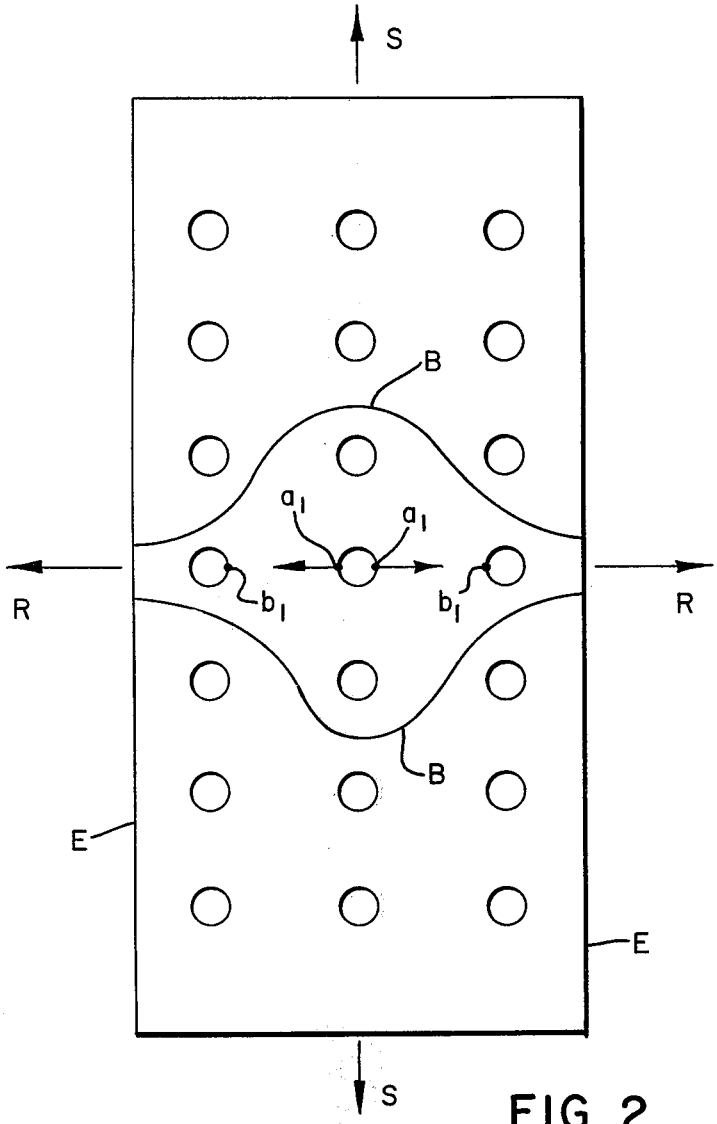
FIG. 2 PRIOR ART

FIG. 2 shows a modification of the fusible element of FIG. 1 including seven lines and three columns of circular perforations. When the fusible element of FIG. 2 is carrying current the temperature distribution therein involves gradients in a direction longitudinally thereof and gradients in transverse direction. The points of highest temperature have been marked $a_1$. The temperature decreases from points $a_1$ toward points $b_1$, and from there further toward the longitudinal edges E of the ribbon fuse link. Considering the temperature distribution along the longitudinal edges E of the ribbon fuse link, it is highest at their centers and lowest at their ends.

The sequence of fusion of the various points of the fusible element and formation of breaks at these points depends again upon the profile of temperature distribution in longitudinal and in transverse direction. Considering major fault currents, the fuse link will be first severed at its center in transverse directions R and thereafter breaks will be formed sequentially in the directions S. The sequence of break formation at the various points of reduced cross-section is so rapid at major fault currents that break formation may be deemed to occur simultaneously. It is of utmost importance for the successful interruption of major fault currents to minimize the current per point of reduced cross-sectional area or per break, and to arrange a sufficiently large number of points of reduced cross-sectional area, or of breaks, in series. In other words, the successful interruption of major d-c fault currents calls for ribbon fuse links having a matrix-like pattern of points of reduced cross-sectional area. While meeting with this condition is of vital importance for the successful interruption of major d-c fault currents these very same conditions are extremely adverse to the successful interruption of very small protracted overload currents, as will be shown below in more detail.

Relatively small overload currents result in initial fusion and break formation at the hottest region of the fusible element or fusion and severance of the fusible elements beginning at the points $a_1$, progressing to points $b_1$ and then further in the direction of arrows R to the longitudinal edges E of the fusible element. The temperature gradient in transverse direction is much smaller than that in a direction longitudinally of the fusible element and this fact is responsible for what happens after the fusible element is severed and begins to burn back. Backburn tends to progress faster along the longitudinal median plane of the fusible element where temperatures are highest rather than along the longitudinal edges E of the fusible element where temperatures are relatively low. The front of backburn has been indicated by the lines B—B, i.e., lines B—B indicate backburn at a given time following complete severing of the fusible element and arc inception.

There are instances when a fusible element of the type shown in FIG. 2 will interrupt satisfactorily excess d-c currents. The width required for the fusible element or fuse link may exceed the diameter of a tubular fuse casing of standard size, but this difficulty can be overcome by folding the fuse link in such a way as to fit into a casing of standard size. Under onerous conditions a fuse having a fuse link as shown in FIG. 2 is not capable of effecting interruption of very small d-c overload currents. The term onerous conditions implies currents which are relatively close to the minimum fusing current, resulting in small current densities and small backburn velocities and fusion occurring only after extended pre-heating periods. The term onerous conditions further implies that the time constant of the circuit is high, i.e., that the ratio of L/R is high, L being the inductance of the circuit in henries and R its resistance in ohms. The term onerous conditions further implies that the open circuit voltage of the d-c circuit in which the fuses are intended to be used is relatively high or, to be more specific, at least 500–600 volt.

Under onerous conditions fusible elements as shown in FIG. 2 tend to result in fuse failure. It is the primary object of this invention to provide fuses capable of interrupting d-c circuits under onerous conditions. It is a further object of this invention to provide fuses for d-c circuits including parts of gas-evolving materials, i.e., materials evolving arc-quenching gases under the action of electric arcs, which fuses are more effective than comparable prior art fuses relying on the action of gas-evolving materials for interrupting small d-c currents. A further object of this invention to provide d-c fuses which comply with the Rules and Regulations of the Department of the Interior, Bureau of Mines (Federal Register Vol. 37, No. 74, Part II, Apr. 15, 1972.

It is well known to use gas-evolving materials for arc-quenching purposes. It is, however, not apparent in what form gas-evolving materials can be effectively applied in connection with wide multiperforated fuse links as shown in FIG. 2 which — aside from their limitations stated above — appear to be particularly desirable for d-c fuses. Non-tracking gas-evolving materials, in particular compounds of melamine resins and inorganic binders as, for instance, aluminum trihydrate, are relatively expensive. This fact as well as the tendency of gas-evolving materials to generate excessive pressures at major fault currents compels to strictly limit the mass of gas-evolving material present at the arcing zone of a given fuse, but the large surface of the fusible element of FIG. 2 seems to call for the provision of a large mass of gas-evolving material at the arcing zone. Because of the backburn pattern of a fusible element of fuse link as shown in FIG. 2 indicated by the lines B,B therein, no significant improvement of the performance of the fusible element shown therein by the addition of a gas-evolving material can be expected unless the action of the arc-quenching gas can be concentrated at the edges E where the backburn velocity is smallest and gap-formation too small and dielectric strength too low.

It has been found that the most difficult situation exists where a fuse has but one single fusible element in form of a perforated ribbon as shown in FIG. 2 rather than a plurality of fusible elements in ribbon form which are connected in parallel. It has also been found that particular consideration must be given to the presence of a low fusing point link-severing overlay as generally used for obtaining time delay. The fuse structure described below is one involving one single fusible element in form of a relatively wide multiperforated ribbon of copper or silver which is provided with a transversely extending link-severing overlay of a low fusing point metal as, for instance, tin.

Figure 3:
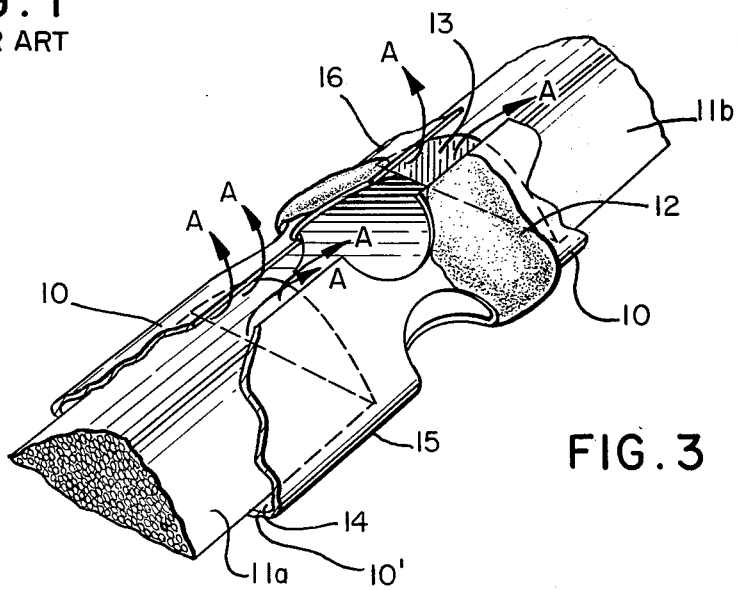
FIG. 3 is an isometric view of a portion of a fuse embodying this invention.
Figure 4:
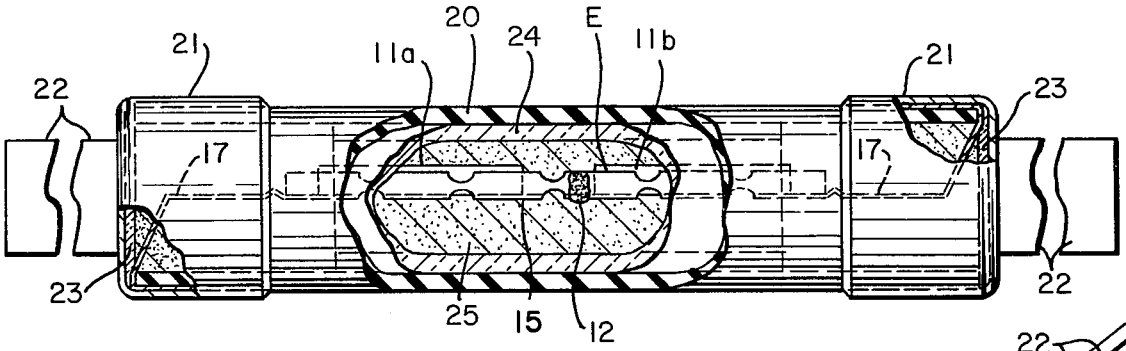
FIG. 4 shows a fuse embodying this invention partly in longitudinal section and partly in elevation.
Figure 5:
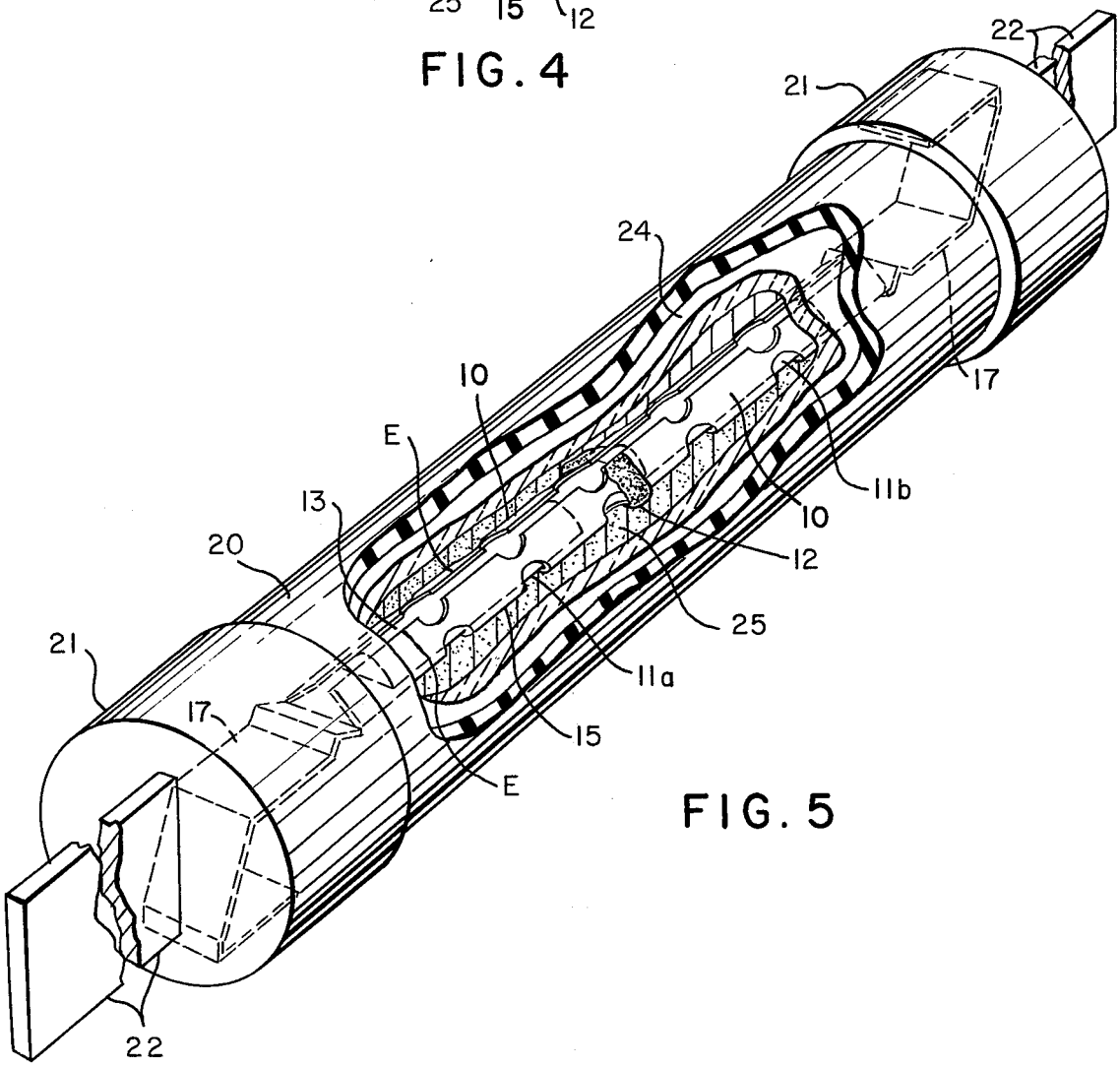
FIG. 5 is an isometric view of a fuse embodying this invention.

Referring now particularly to FIGS. 3,4 and 5, numeral 20 has been applied to indicate a tubular casing of electric insulating material which is closed by a pair of electroconductive terminal caps 21 at the ends thereof. Rod means 11*a*, 11*b* of a gas-evolving electric insulating material are arranged inside of casing 20 and substantially parallel to the longitudinal axis thereof. The cross-section of rod means 11*a*, 11*b* is substantially in the shape of a parabola, and rod means 11*a*, 11*b* have a substantially planar surface and a curved surface. The circumference of rod means 11*a*, 11*b*, has a predetermined length. The axially outer end surfaces of rod means 11*a*, 11are spaced from terminal caps 21 and the axially inner end surfaces of rod means 11*a* 11*b* are spaced from each other. Terminal caps 21 are conductively interconnected by a ribbon fuse link, or fusible element in ribbon form, having axially outer ends or tabs 17. These ends or tabs 17 which are narrower than the perforated center of the fusible element are bent around the rims or axially outer edges of casing 20, and are engaged by the inner surfaces of terminal caps 21. The latter may be provided with blade contacts 22 and asbestos washers 23 or the like may be arranged inside terminal caps 21 covering the end surfaces thereof. The portion of the fusible element between the terminal tabs 17 thereof has a width which substantially exceeds the circumference of gas-evolving rod means 11*a*, *11b*. This portion of the fuse link has a plurality of transverse lines of perforations and a plurality of longitudinal columns of perforations substantially as shown in FIG. 2 and explained in the context of FIG. 2. The perforated wide portion of the ribbon fuse link is wrapped around gas-evolving rod means 11*a*, 11*b* so as to position said rod means. When wrapped around parts 11*a*,11*b* the perforated wide portion of the ribbon fuse link forms a gap 13 between the longitudinal edges E thereof. The perforated wide portion of the ribbon fuse link is bent along two straight lines indicated at 15 and 16 and includes two lateral portion 10 wrapped around the curved surfaces of gas-evolving rods 11*a*, 11*b* and a planar base 10' juxtaposed to the planar base of rod means 11*a*, 11*b*. Reference character 12 has been applied to indicate an overlay of a low fusing point link-severing metal, e.g. tin, supported by the base metal of which the ribbon fuse link is made, e.g. copper or silver. The link-severing overlay 12 extends transversely across the portion of the ribbon fuse link where its width is most extensive, i.e., from one lateral edge E to the other lateral edge E of the ribbon fuse link. The axially inner end surfaces of rod means 11*a*, 11*b* are spaced in axial direction from overlay 12. The inside of casing 20 may be provided with an internal lining 24 substantially of asbestos fibers. The length of this lining 24 is approximately the same as the length of the wide perforated portion of the ribbon fuse link. Casing 20 is filled with a pulverulent arc-quenching filler 25, e.g. quartz sand, into which the fusible element and rods 11*a*,11*b* are embedded.

When a fuse structure as shown and described is arranged in a d-c circuit and subjected to a major fault current, all points of reduced cross-sectional area of the wide center portion of the fuse link fuse in a rapid sequence or virtually simultaneously. The arc voltage then generated at many points of break in series and many points of break in parallel is sufficiently high to force the current rapidly down to zero even in the presence of a considerable driving voltage exceeding, for instance, 600 volts. The gas-evolving material of which rods 11*a*, 11*b* are made is largely gasified under major fault conditions. Its gasification results in a beneficial rise of pressure inside of casing 20. The relatively limited volume or mass of rods 11*a*, 11*b* precludes a dangerous or excessive rise in pressure inside casing 20 tending to cause bursting of the latter.

Under conditions of relatively small protracted overload currents interruption is initiated by fusion of overlay 12. Fusion of overlay 12 occurs at a temperature which gas-evolving rods 11*a*, 11*b* can withstand for long periods of time, even if made of a synthetic resin, e.g. a melamine resin. Following fusion of overlay 12 the resistance of the area of the fusible element coextensive with overlay 12 increases greatly due to the formation of alloys of high resistivity, resulting in a rise of temperature at this area way above the fusing point of overlay 12. This post-fusion and prearcing rise in temperature has the tendency of damaging parts of synthetic resins arranged immediately adjacent overlay 12. For this reason two separate gas-evolving rods 11*a*, 11*b* are wrapped into the ribbon fuse link of which each rod is spaced from overlay 12. The ribbon fuse link is first severed by formation of a gap progressively widening in transverse direction as explained above in connection with FIG. 2. Arcing and backburn are initiated after the ribbon fuse link is severed at its center into two separate parts. The backburn pattern follows substantially that shown in FIG. 2, i.e., backburn tends to progress relatively rapidly adjacent the longitudinal center line of the ribbon fuse link and progresses relatively slowly adjacent the edges E of the ribbon fuse link which are separated by gap 13. As backburn progresses rods 11*a*, 11*b* evolve large amounts of arc-quenching gases. Some of these gases are allowed to escape through openings other than gap 13, yet a large portion of the gas evolved from rods 11*a*, 11*b* escapes through gap 13, as indicated by arrows A, and this tends to expedite the dielectric recovery of the arc gap adjacent the edges E thereof where the arc gap tends to be smallest.

The fuse structure shown in the drawings has been tested in stiff circuits over a wide range of overload currents and major fault currents and it appears to outperform all prior art d-c fuses. Its performance is particularly significant in the range of currents slightly above the minimum fusing current, as shown below in detail.

Tests were conducted with identical pairs of fuses. The first fuse of each pair was placed in a circuit having a circuit voltage of less than 600 volts and caused to carry a relatively small current until fusion occurred. This kind of test yielded fusing time data for given currents. Thereupon the second fuse of each pair was placed in the same circuit and caused to carry the particular current causing fusion within the particular fusing time determined by the previous test for a period of time a few seconds less than the particular fusing time. At the end of this period of time the terminals of the fuse were quickly disconnected from the power supply having the above referred-to low circuit voltage and rapidly connected to a power supply having a circuit voltage in excess of 600 volts. The following data refer to two tests conducted along the above lines in a circuit having a circuit voltage above 600 volts and a time constant $T = L/R = 0.004$.

1. Fusing time 45 minutes; fusing current 130 amps. d-c; switchover to 645 volt d-c 5 sec. before expiration of the fusing time. Test result: Perfect clearing of overload current.
2. Fusing time 2 hrs. and 16 min.; fusing current 165.5 amps. d-c; switchover to 645 volt d-c 10 sec. before expiration of the fusing time. Test result: Perfect clearing of overload current.

As mentioned above it appears that the interruption of overload currents in d-c circuits is particularly difficult in instances where fuses have a relatively small current rating — less than 100 amps or slightly exceeding 100 amps — calling for the use of one single fusible element rather than a plurality of fusible elements connected in parallel. The fuse which is illustrated in the drawings is such a single fusible element fuse.

The provision of two separate and separated gas-evolving rods 11*a*, 11*b* is a matter of design economy because of the little effectiveness of gas-evolving materials at a region where they are likely to be thermally damaged prior to arc-inception. However, the presence of gas-evolving material at such a region does not adversely affect the operation of the fuse as long as there is sufficient gas-evolving material present to establish after arc inception effective flows of arc-quenching gases through gap 13 and transversely across the longitudinal edges E of the wide center portion of the fusible element.

The length of rods 11*a*, 11*b* is not critical. Their required minimum length depends upon several parameters. In a fuse rated 600 volts d-c, 100 amps constructed as disclosed above and tested in accordance with the above referred-to Rules and Regulations of the Department of Interior, Bureau of Mines, successful performance required a length of 1 ⅜ inches for each rod 11*a*, 11*b*. Shortening the length of each gas-evolving rod to ⅝ inch resulted in fuse failure.

Any fuse link which is relatively wide and has several columns of perforations, as diagrammatically shown in FIG. 2, has a very limited dimensional stability, even if folded for one reason or another. Rod means 11*a*,11*b* are not only essential as far as the electrical performance of the fusible element is concerned, but tend to greatly increase the dimensional stability of a fusible element structure which is inherently fragile, particularly if the size of its perforations is relatively large.

It will be apparent from the foregoing that rods 11*a*,11*b* are affixed to the ribbon fuse link without resorting to special fastener means because of the wrap-around feature of the ribbon fuse link. The center portion of the fuse link engages rods 11*a*, 11*b* at discrete angularly displaced regions thereof and exposes other regions of rods 11*a*, 11*b*. The arc-quenching filler 25 of quartz sand surrounds all points of the ribbon fuse link out of engagement with rods 11*a*, 11*b*.

We claim as our invention:

1. A fuse for controlling d-c circuits including a. a tubular casing of electric insulating material;

b. a pair of electroconductive terminal elements closing the ends of said casing;

c. a pulverulant arc-quenching filler inside said casing;

d. straight rod means of a gas-evolving electric insulating material inside said casing arranged substantially parallel to the longitudinal axis thereof, said rod means having a circumference of predetermined length; and e. a ribbon fuse link including a portion having a predetermined width substantially exceeding said predetermined length of said circumference of said rod means conductively interconnecting said terminal elements, said portion of said ribbon fuse link having a plurality of transverse lines of perforations and a plurality of longitudinal columns of perforations, and said portion of said ribbon fuse link being wrapped around said rod means so as to position said rod means relative to said portion of said ribbon fuse link, and said portion of said ribbon fuse link forming a gap between the longitudinal edges thereof causing arc-quenching gases to escape from said rod means transversely across said longitudinal edges of said portion of said fuse link.

2. A fuse as specified in claim 1 having one single ribbon fuse link conductively interconnecting said pair of terminal elements, said ribbon fuse link being provided with a link-severing low fusing point overlay and being wrapped around a pair of gas-evolving rods having axially inner ends spaced from said overlay.

3. An electric fuse for interrupting d-c circuits including a. a tubular casing of electric insulating material;

b. a pair of terminal elements arranged at the ends of said casing and closing and casing;

c. a ribbon fuse link conductively interconnecting said pair of terminal elements, said fuse link including a center region having a predetermined width and a plurality of transverse lines of perforations and a plurality of longitudinal columns of perforations;

d. a link-severing low fusing point overlay extending transversely across said center region of said fuse link;

e. rod means of a substance evolving gases under the heat of electric arcs, said rod means having a circumference which is less than said predetermined width of said center region of said fuse link and said rod means being affixed to said center region of said fuse link without resorting to fastener means by a wrap-around of said center region of said fuse link in such a way that said center region of said fuse link engages said rod means at discrete angularly displaced areas thereof and exposes other areas of said rod means; and e. a pulverulent arc-quenching filler inside said casing surrounding said fuse link at all points thereof out of engagement with said rod means.

4. An electric fuse as specified in claim 3 wherein said pair of terminal elements is conductively interconnected by one single ribbon fuse link having a center region being wrapped around a pair of rods of a substance evolving gases under the heat of electric arcs, and wherein said pair of rods have axially inner ends arranged in spaced relation from said link-severing low fusing point overlay.

* * * * *